US009695516B2

(12) United States Patent
Wei et al.

(10) Patent No.: US 9,695,516 B2
(45) **Date of Patent: *Jul. 4, 2017**

(54) GRAPHITE OXIDE AND GRAPHENE PREPARATION METHOD

(71) Applicant: National Chiao Tung University, Hsinchu (TW)

(72) Inventors: Kung-Hwa Wei, Hsinchu (TW); Van Thanh Dang, Hsinchu (TW)

(73) Assignee: NATIONAL CHIAO TUNG UNIVERSITY, Hsinchu (TW)

( * ) Notice: Subject to any disclaimer, the term of this patent is extended or adjusted under 35 U.S.C. 154(b) by 306 days.

This patent is subject to a terminal disclaimer.

(21) Appl. No.: 14/319,397

(22) Filed: Jun. 30, 2014

(65) Prior Publication Data

US 2015/0060297 A1 Mar. 5, 2015

(30) Foreign Application Priority Data

Aug. 30, 2013 (TW) ..... 102131304 A

(51) Int. Cl.
*C25B 1/00* (2006.01)

(52) U.S. Cl.
CPC ..... *C25B 1/00* (2013.01)

(58) Field of Classification Search
CPC ..... C25B 1/10
USPC ..... 205/555
See application file for complete search history.

(56) References Cited

U.S. PATENT DOCUMENTS 9,096,938 B2 * 8/2015 Wei ..... C25B 1/00
2013/0306487 A1 * 11/2013 Lu ..... C25D 11/026 205/333
2014/0216944 A1 * 8/2014 Wei ..... C25B 1/00 205/555

OTHER PUBLICATIONS

Richenderfer, Plasma-assisted Electrochemical Synthesis of Pristine Graphene Sheets, Apr. 2012.*
Paulmier et al, Deposition of Nano-crystalline Graphic Films by Cathodic Plasma Electrolysis, Thin Solid Films 515 (2007) 2926-2934.*

(Continued)

*Primary Examiner* — Keith Hendricks
*Assistant Examiner* — Salil Jain
(74) *Attorney, Agent, or Firm* — Muncy, Geissler, Olds & Lowe, P.C.

(57) ABSTRACT

A graphite oxide and/or graphene preparation method includes providing a plasma electrolytic apparatus, wherein an electrolyte is provided and a graphite electrode is configured as a cathode of the plasma electrolytic apparatus; and providing a cathodic current so as to initiate a plasma electrolytic process at the graphite electrode to obtain graphite oxide and/or graphene. The graphite oxide and/or graphene can be synthesized through plasma electrolytic processing at relatively low temperature under atmospheric pressure within a very short period of time, without the need for concentrated acids or strong oxidizing agents. The present invention may prepare graphite oxide and/or graphene with plasma electrolytic process directly from graphite, without requiring any prior purification or pretreatment. This plasma electrolytic process of the present invention is quite promising and provided with advantages such as low cost, simple setup, high efficiency, and environmental friendliness.

10 Claims, 7 Drawing Sheets

(56) References Cited

OTHER PUBLICATIONS

T. Paulmier, et al., "Deposition of nano-crystalline graphite films by cathodic plasma electrolysis", *Thin Solid Films*, vol. 515, Issue 5, Jan. 22, 2007, pp. 2926-2934.
Andrew Richenderfer, "Plasma-assisted Electrochemical Synthesis of Pristine Graphene Sheets", Paper, Apr. 28, 2012, pp. 1-28.

* cited by examiner

GRAPHITE OXIDE AND GRAPHENE PREPARATION METHOD

BACKGROUND OF THE INVENTION

1. Field of the Invention

The present invention is related to a graphite oxide and graphene preparation method, particularly to a graphite oxide and graphene preparation method with plasma electrolytic process.

2. Description of the Prior Art

Graphene is a newly discovered carbon nanomaterial and provided with many excellent properties such as linear spectrum, high electron mobility, the unique optical properties, high elasticity, sturdiness and single atomic width. The graphene is viewed as a breakthrough nanomaterial for applications in optoelectronics, energy and chemical material fields.

Since the graphite oxide can be used in manufacturing graphene, it has attracted great attention. The chemical reduction of the exfoliated graphite oxide has been widely considered to be the most promising approach for a large-scale production of graphene. Such process involves (I) oxidation of graphite to graphite oxide (GO) (II) exfoliation of GO through ultrasonication or thermal treatment to yield graphene oxide; and (III) chemical reduction of graphene oxide to a graphitic network of $sp^2$-hybridized carbon atoms.

However, in the prior art, the mixtures of strong oxidants and concentrated acids are required for preparing GO and thus graphene in large scale, and strong acids are dangerous and unstable during the processing, requiring extra safety precautions. Moreover, the discharge of large quantity of acidic waste poses an environmental risk. Therefore, the preparation method of the graphite oxide still needs substantial improvements.

Paulmier. et al (Thin Solid Films 515(5):pp. 2926-2934) disclosed a cathode plasma electrolytic method to deposit the nano-crystalline graphite films. Paulmier placed graphite on the anode although Paulmier taught deposit carbon film on the cathode. Richenderfer et al (http://www.phys.cwru.edu/undergrad/Senior%20Projects/papers/papers2012/Richenderfer_Gao.pdf) taught that deposit carbon film on the cathode and promote the exfoliation of the graphite by passing the current through the electrolyte, but placed graphite on the anode and employed micro-plasma as the electrode to enhance the electric filed. Also, Richenderfer used acidic electrolyte (containing HCl) along with an electrochemical method that in needs of concentrated acid for reaction. Since the acidic solution manipulation in Richenderferes method is required, it leaves room for improvement.

In summary, it is now a current goal to develop a graphite oxide/graphene preparation method with advantages such as high efficiency and environmentally friendliness.

SUMMARY OF THE INVENTION

One objective of the present invention is directed towards developing a graphite oxide and/or graphene preparation method with low cost, easy preparation, efficiency and environmentally friendliness.

According to an embodiment of the present invention, a graphite oxide and/or graphene preparation method comprises the following items and steps: providing an in situ plasma electrolytic apparatus that comprise an electrolyte, a cathode that is a graphite electrode for generating the plasma on its interfacial areas that are in contact with the electrolyte, due to the cathodic current passes through the graphite electrode so as to initiate a plasma electrolytic process at its surfaces, which are in contact with the electrolyte but without submerging into the electrolyte, to obtain the graphite oxide and/or the graphene that depends on the input voltage and the PH value of the basic electrolyte, wherein the input voltage of the plasma electrolytic apparatus is between 20 V to 80 V, and the output current of the plasma electrolytic apparatus is 0.3 A to 1.75 A. Here, in situ refers to that the plasma producing graphite cathode is also the source for generating exfoliated graphene oxide or graphene.

In one embodiment, the graphene comprises low proportion of oxide, wherein the sum of the C═C and C—C bonds of the graphene is larger than the sum of the C—O bonds.

The purpose, technical content, characteristic and effect of the present invention will be easy to understand by reference to the following detailed descriptions, when taken in conjunction with the accompanying drawings and the particular embodiment.

BRIEF DESCRIPTION OF THE DRAWINGS

FIG. 2*a* shows the photograph of the electrolyte before the plasma-assisted electrochemical exfoliation process; FIG. 2*b* shows the photograph of the electrolyte after the plasma-assisted electrochemical exfoliation process; FIG. 2*c* shows Plasma-assisted electrochemical exfoliated graphene (PEEG) obtained by vacuum filtering electrolyte after plasma-assisted electrochemical exfoliation process; and FIG. 2*d* shows dispersion of PEEG in NMP solution.

DESCRIPTION OF THE PREFERRED EMBODIMENT

Figure 1:
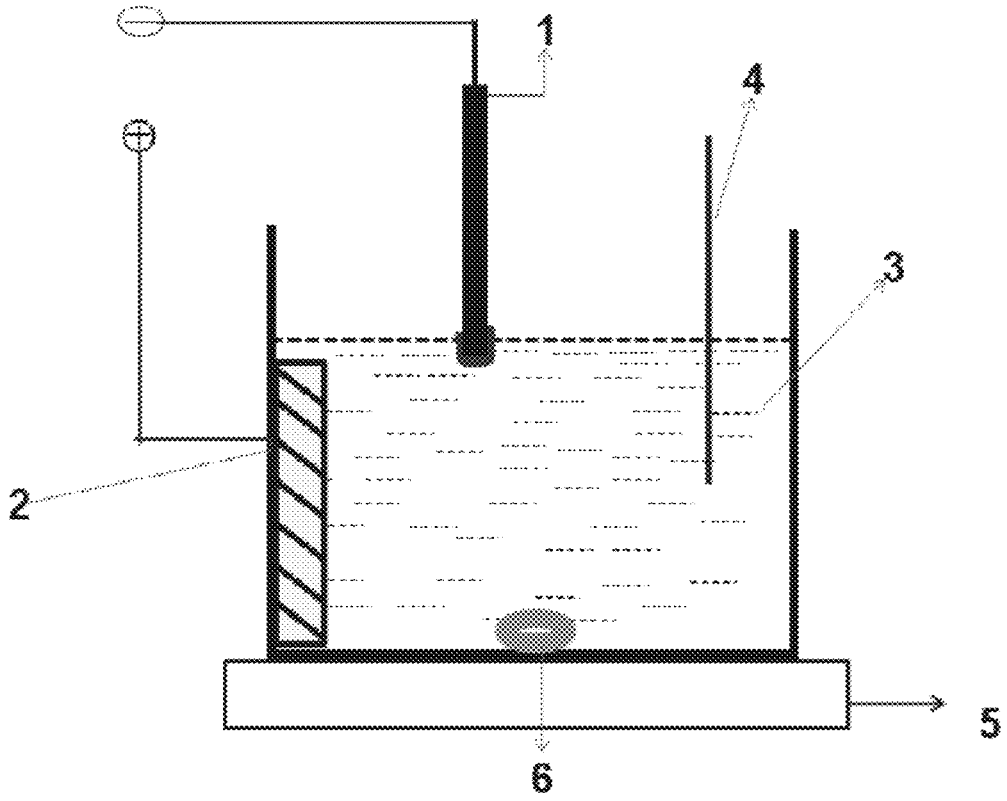
FIG. 1 is a schematic diagram illustrating a plasma electrolytic apparatus of the present invention.

Please refer to FIG. 1, which is a schematic diagram illustrating an in situ plasma electrolytic apparatus of the present invention. A graphite oxide and/or graphene preparation method of the present invention comprises the following steps: providing a plasma electrolytic apparatus including an electrolyte 3, the cathode 1 of the plasma electrolytic apparatus is a graphite electrode; and providing a cathodic current to the graphite electrode so as to initiate a plasma electrolytic process at the graphite electrode to obtain the graphite oxide and/or the graphene.

The conventional plasma electrolytic oxidation reaction, also known as micro-arc oxidation (MAO) technology, can be also called anodic spark deposition and is usually used in preparation/production of aluminum, magnesium and titanium alloys. In the case of conventional plasma electrolytic oxidation adopts the work piece at a positive electrode and the electrode at the negative electrode, an oxide film as an insulating layer is formed on the surface of the substrate after the current passes through and the oxide film is also functioned as a base layer. The voltage is continuously applied until the voltage on the substrate exceeds the threshold, and some vulnerable areas of the insulating film will be breakdown, resulting in the phenomenon of micro-arc discharges. There are some changes occurring at the structure of the oxide film and resulted in the anodized metal. Therefore, the voltage applied in the plasma electrolytic reaction is generally higher in comparison to that applied in the conventional electrochemical reaction.

The anode 2 of the plasma electrolytic apparatus of the present invention are made of conductive materials and are not limited in principle, for example but not limited to graphite electrode and stainless steel or Pt. However, it is noted that the plasma electrolytic oxidation method of the present invention is different from conventional anodic spark deposition reaction. In this way, in one embodiment of the present invention, the anode 2 of the plasma electrolytic apparatus of the present invention is not made of conductive materials such as aluminum, magnesium, or titanium.

In the embodiment, the output voltage of the plasma electrolytic apparatus is 40 V to 80 V, and the output current thereof is 0.5 A to 1.75 A. In a preferred embodiment, the output voltage is 40 V to 60 V and the output current is 0.5 A to 1.2 A. The adjustment of the voltage and current in the present invention is used to generate plasma-assisted electrochemical exfoliation process in the plasma electrolytic apparatus, but prevent over high current which make the graphite oxide overproduction. The way of the adjustment for the current intensity includes, but not limited, output power, electrolyte concentration, and the relative size and location of the anode and cathode.

In the plasma electrolytic apparatus of the present invention, the area immersed into the electrolyte of the anode 2 is larger than that of the cathode 1, preferred larger than 11 times.

As shown in FIG. 1, the anode 2 of the plasma electrolytic apparatus immerses into electrolyte 3 completely during preparation of graphite oxide/graphene. One end of the graphite electrode of the cathode 1 is higher than the surface of the electrolyte 3, and the plasma electrolytic reaction occurs at or near the surface of the graphite electrode.

The graphite electrodes used in the present invention does not necessarily require prior purification or any pretreatment. Therefore, the source of the graphite electrode of the present invention may include without limitations to natural graphite, compressed graphite, partially oxidized graphite or recycled graphite. Here, the recovered graphite electrode may be obtained from graphite electrode in the recycled batteries. In one embodiment, the graphite electrode is preferred as a high purity graphite electrode to obtain higher proportion of the graphene.

The pH of the electrolyte 3 used in the present invention may range from 11-17, preferably 11-14. The alkaline provider includes, but not limited, hydroxide, carbonate and the like.

The electrolyte 3 of the present invention may contain some appropriate electrolytes to control the conductive values. Here, in a preferred embodiment, the electrolyte 3 of the present invention may include ammonium ion to control and maintain the pH value of the electrolyte 3. In addition, the ammonium ions can be used to produce and release $NH_3$ so as to drive and provide expanded graphite. Examples of ammonium ion provider may include without limitations to $(NH_4)_2SO_4$, $NH_4NO_3$ or $NH_4Cl$. In addition, the electrolyte 3 containing carbonate and ammonia may be used for reaction in order to control and maintain the pH value of the electrolyte 3 and to promote reaction of graphite electrodes.

In one embodiment, the heating plate 5 (as shown in FIG. 1) may be used to heat the electrolyte during the plasma electrolytic reaction at the graphite electrode, and the thermometer 4 may be used to measure temperature. Wherein the initial temperature is preferably 70° C., but the reaction temperature used in the present invention is not limited thereto.

In one embodiment, to enhance exfoliation and the homogeneity of the reaction, the magnetic stirrer 6 is used for stir in the beaker, and the magnetic stirrer 6 is driven by the heating plate 5 with magnetism.

The graphite oxide may be obtained by the plasma electrolytic reaction described above, and then continue subsequent purification step. The purification step includes, but not limited, filtration or centrifugation, and the like.

It is noted that the graphite oxide and graphene mixture may be obtained by the plasma electrolytic reaction described above. In a preferred embodiment, the graphite oxide and/or graphene include low proportion of oxide, wherein the total amount of the C═C and C—C is larger than the amount of C—O, suggesting that the graphene is more than the graphite oxide. In a preferred embodiment, the amount of C—O is less than 10%.

The purpose, technical content, characteristic and effect of the present invention will be easy to understand and implement by reference to the following detailed descriptions, when taken in conjunction with the accompanying drawings and the particular embodiment, but not limit the claim of the present invention.

Preparation of PEEG

The electrolyte, comprising KOH (5%, 200 mL) and $(NH_4)_2SO_4$ (2.5%, 40 mL) at a pH of approximately 12, was preheated to an initial temperature of 70° C. A high purity graphite (HG) cylinder was used as the cathode and connected to a voltage supply unit (output negative voltage), the diameter and length of the cathode were 6 and 100 mm, respectively. The diameter and length of the other HG were 6 and 150 mm, respectively, and was used as anode in plasma-assisted electrochemical exfoliation (PAEEP) electrochemical system. The cathode of the tip surface of HG is placed above the electrolyte surface approximately 1 mm, and the anode thereof is immersed into the electrolyte. Both electrodes are connected to a DC current and offset voltage, which is gradually increased into 60 V, such that the area adjacent to cathode of the tip surface of HG and the electrolyte generates discharged plasma. In such process, solution temperature in the beaker is measured by a conventional mercury thermometer and maintained at 70-80° C. To enhance exfoliation and the homogeneity of the reaction, the magnetic stirrer was used for stir in the beaker, and maintained at the speed of 200 rpm/min. When the sufficient voltage 60 V between two electrodes was applied, the electrochemical reaction starts, and gases generate at both the surface of electrodes and the plasma is generated in the cathode of the tip surface of HG, simultaneously. As the result, the surface of the graphite electrode degrades slowly into sheets in micro size and dispersed in the electrolyte. It is noted that the tip position of the cathode may be lowered down to maintain the current range at approximately 0.65 to 1.25 A. The processing time for the sample applying 5 minutes. FIG. 1 provides the schematic diagram of the setup of the apparatus. After cooling down to room temperature and passing through the vacuum filtration, the solution is filtered through the PVDF film (average pore size: 0.2 μm) supported by a fritted glass holder, and the exfoliated graphite sheets was collected. The prepared product was washed with DI water, and dried at 60° C. in vacuum for 24 h. After exfoliating from the PVDF membranes, the powder prepared from PAEEP as described above will be referred to as PEEG hereinafter, and stored in the dry box at 50° C. until use.

Preparation of PEEG Dispersion

Adding the obtained PEEG (15 mg) into N-methyl-2-pyrrolidone (NMP) (15 mL) to obtain PEEG dispersion (1 mg/mL), and employ the ultrasonic cleaning tank, 20 kHz, power 130 W, 10 minutes.

Characterization

The structures of the HG and PEEG powders were examined by a D2 X-ray diffractometer equipped with a Cu-Kα tube and a Ni filter (λ=0.1542 nm). The surface chemical compositions of HG and PEEG were determined by XPS (Phi V6000). Raman spectra of these samples were recorded using a high-resolution confocal Raman microscope (HOROBA JOBIN YVON Laboratory RAM HR 800) and a 514.5 nm Argon laser source. High resolution transmission electron microscopy (HRTEM) images were recorded using a JEOL 2100F apparatus operated at 200 kV; for HRTEM measurement, a few drops of the HG, PEEG dispersion were placed on a Cu grid presenting an ultrathin holey C film. Scanning Electron Microscopy (SEM) was done using a JEOL JSM-6500F scanning electron microscope at 15 kV. For characterization of SEM sample, PEEG dispersion was filtered through an AAO membrane (Anodisc; diameter: 47 mm, nominal pore size: 0.02 μm), the solids were then dipped in EtOH to remove residual NMP, the sheets that floated on the surface of the EtOH were collected on a Si substrate for SEM measurement.

Figure 2:
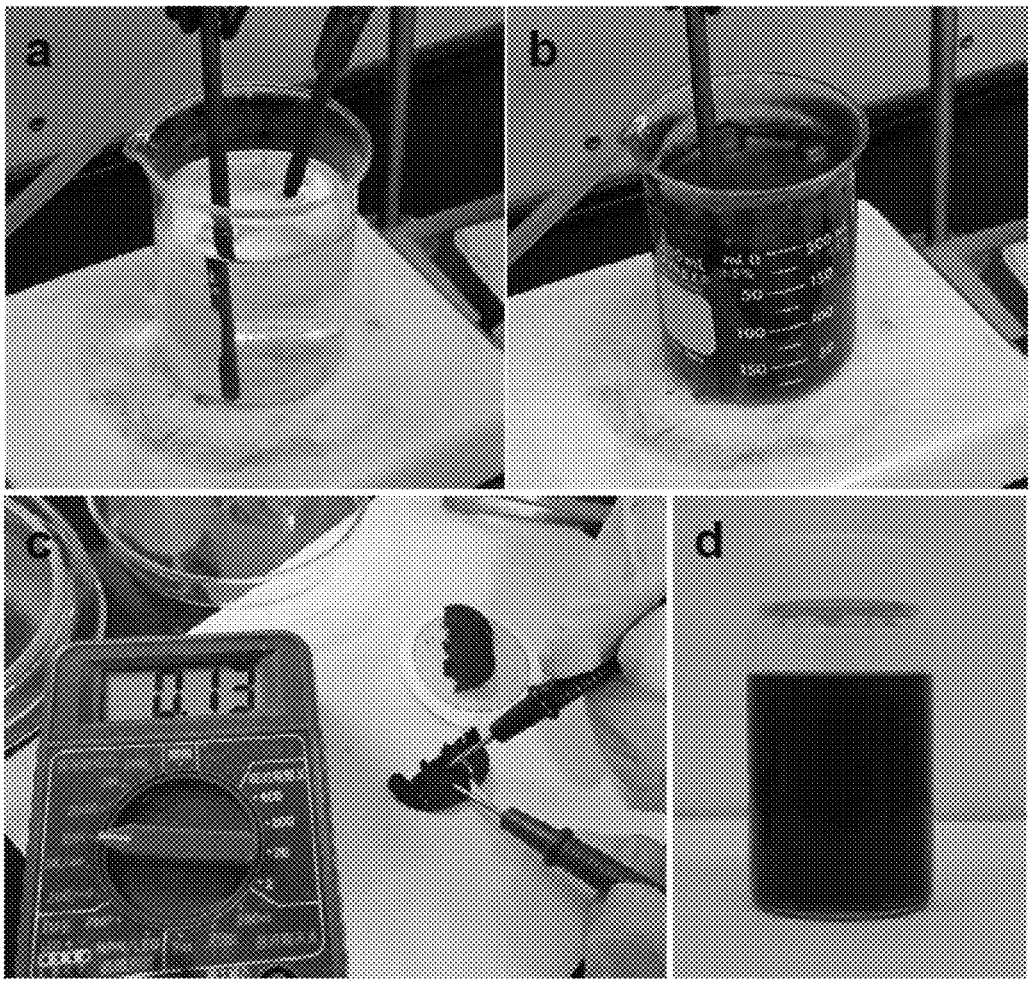
FIG. 2 shows the photographs of the electrolyte before and after the plasma-assisted electrochemical exfoliation process.

FIG. 2 shows photographs of electrolyte at various time of plasma-assisted electrochemical exfoliation process (PAEEP), reveal the significant change in color, from colorless to dark color in only 5 minutes, suggesting high exfoliation rate of the method in the present invention. The resulting/exfoliated graphite sheets were collected through vacuum filtration of the electrolytic solution through PVDF membranes (average pore size: 0.2 μm) supported on a fritted glass holder. The prepared-product was washed with DI water, and dried at 60° C. in vacuum for 24 h. After exfoliating from the PVDF membranes, the powder prepared from PAEEP as described above will be referred to as PEEG hereinafter, and stored in the dry box at 50° C. until use. FIG. 2*d* shows pictures of PEEG in NMP after settling for 6 hours, exhibits good dispensability and homogeneity that are stable for periods of 72 hours, which is desirable for processing. It is noted that PEEG-based graphene film prepared by vacuum filtering electrolyte after PAEEP exhibited a good conductive property (130 $\Omega \cdot sq^{-1}$) using hand-held multimeter (FIG. 2*c*), suggesting potential application in various fields.

Figure 3:
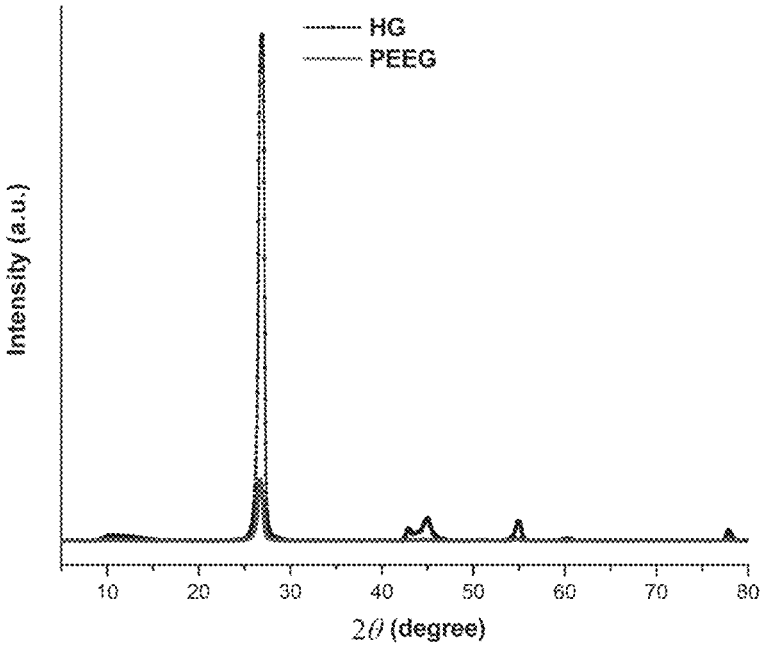
FIG. 3 shows the X-ray diffraction (XRD) patterns of the HG and PEEG of the embodiment of the present invention.

FIG. 3 shows the X-ray diffraction (XRD) patterns of HG and PEEG. The diffraction curve of HG displays a sharp, high-intensity characteristic peak (002) at a value of 2θ of 26.6°, and three small peaks at a value of 2θ of 42.8, 44.6, and 54.6, corresponding to 100, 101, and 004 reflections, respectively (ICDD-PDF #411487). After HG had experienced PAEEP, the characteristic peak (002) at a value of 2θ of 26.6° for HG decreased significantly, suggesting that the graphitic lattice of HG had changed their periodic arrangement in the z-direction after they had exfoliated into foliated graphite sheets.

Figure 4:
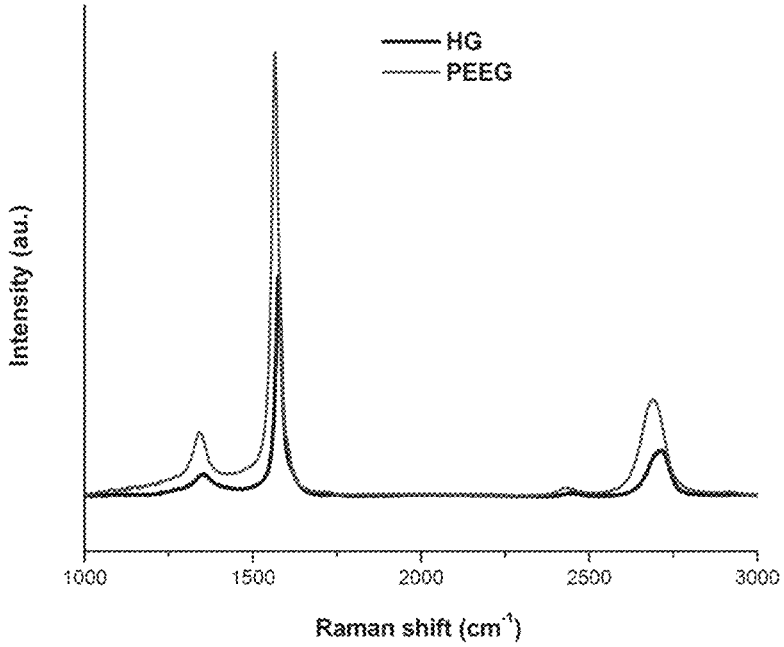
FIG. 4 shows Raman spectra of HG and PEEG of the embodiment of the present invention.

FIG. 4 shows Raman spectra of HG and PEEG. A comparison of the two spectra reveals the structural change from HG to PEEG after PAEEP. The Raman spectrum of HG displayed a weak D (defect), a prominent G (graphite), and a broad 2D (doubly generated G) bands at 1353, 1579, and 2706 $cm^{-1}$, respectively, that are assigned to the characteristic band of graphite. Whereas, in the Raman spectrum of PEEG, the G band was broader and shifted to a lower frequency and the D band is more pronounced in PEEG as compared to that of HG, implying that defect/structural disorder occurred in the graphitic lattice of PEEG after PAEEP. Notably, 2D band of PEEG shift to a lower frequency together with significant intensity change compare to that of HG indicates the formation of graphene structure in PEEG after PAEEP.

Figure 5:
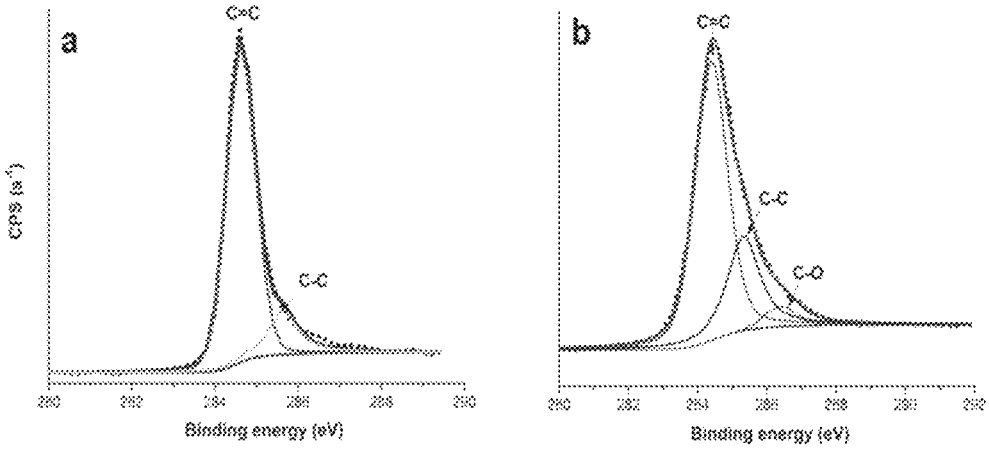
FIG. 5 shows the C1 signal of XPS spectrum for HG (FIG. 5*a*) and PEEG (FIG. 5 *b*).

FIG. 5 demonstrates the C 1 s XPS spectrum for HG. The C 1 s XPS peak for the HG samples can also be deconvoluted into one major peak at 284.4 eV caused by C═C ($sp^2$-hybridized carbon atoms) and a minor peaks at 285.5 eV that was attributed to C—C ($sp^3$-hybridized carbon atoms). FIG. 2*d* displayed the C 1s XPS spectrum for PEEG. C 1s XPS of sample of PEEG can also be de-convoluted into three peaks. The binding energy peak of PEEG at 284.4 and 285.5 eV are attributed to C═C ($sp^2$-hybridized carbon atoms) and C—C ($sp^3$-hybridized carbon atoms), respectively, while the other peaks are assigned to oxygenated component: C—O (~286.4 eV, hydroxyl and epoxy). Clearly, the intensity and sharpness of the graphitic C═C/C—C signals decreased and widened significantly relative to that of the HG sample, implying that oxygen-containing functional groups attack the C═C bonds in the graphite to generate C—O bonds, resulting in their partially oxidation, which may facilitate the interactions between the PEEG and NMP solution result in good dispensability of PEEG (as shown in FIG. 2*d*). In addition, the +60 V voltage applied for exfoliation process can oxidize graphite result in introducing oxygen-containing groups into graphene layer of graphite lattice. Table 1 lists calculated amounts of various oxygen containing groups in HG and PEEG based on the area under these XPS peaks. It can be seen that the atomic percentage ratio of oxygen to carbon atoms in the PEEG is about 1:22.8, which is significantly lower than that of chemically reduced graphene oxide, indicating a very slight oxidation in our process, as evidence of a small amount of C—O bond (~4.2%).

TABLE 1

The relative atomic percentage ratio of various functional groups in HG and PEEG estimated based on the area under C 1s peaks.

| | C═C (%) | C—C (%) | C—O (%) |
|---|---|---|---|
| HG | 84 | 16 | |
| PEEG | 68 | 27.8 | 4.2 |

Figure 6:
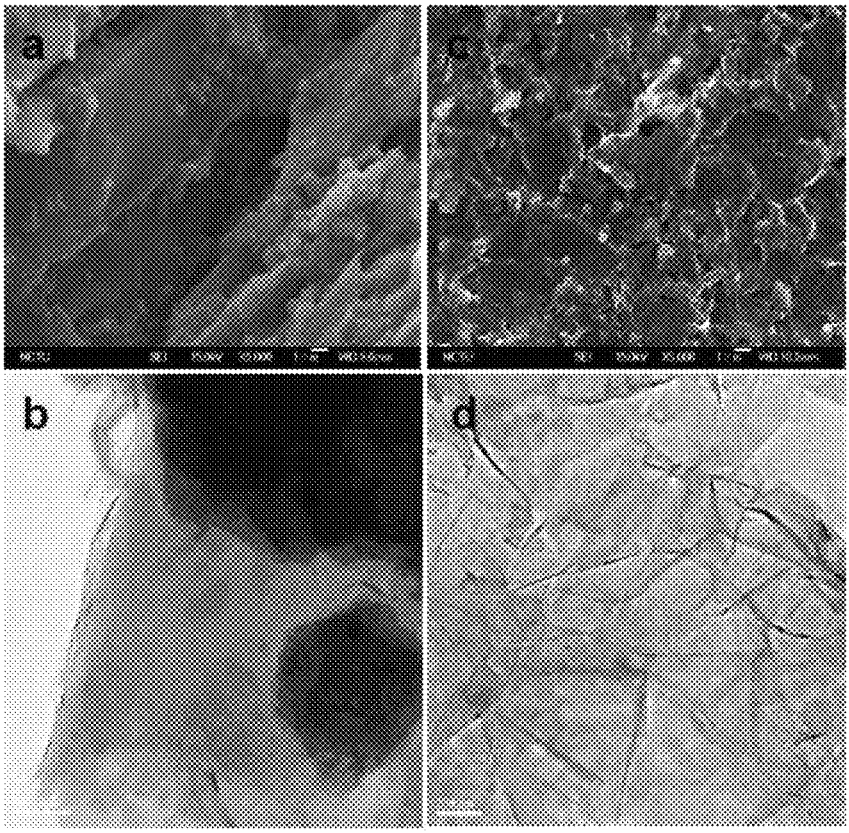
FIG. 6 shows SEM and TEM images of HG (FIG. 6*a*) and PEEG (FIG. 6*b*).
Figure 7:
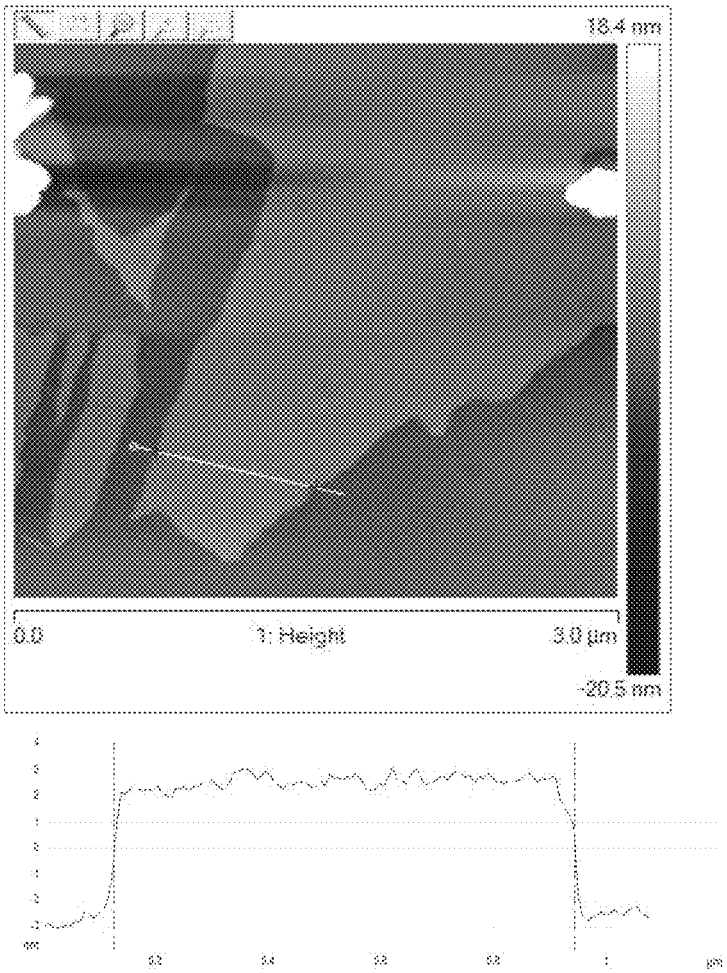
FIG. 7 shows atomic force microscope (AFM) image of a PEEG of the embodiment of the present invention deposited on a $Si/SiO_2$ substrate and height profile thereof.

FIG. 6 presents SEM and TEM photographs of the HG and PEEG samples, indicating dramatic morphology changes in the prepared samples. Clearly, HG is composed of thick-bulk graphite sheets, and was transformed into thinner nanoscale platelets after PAEEP. Image analysis calculation results based on 20-50 expanded graphite sheets revealed that the average sheet diameter was approximately 2.5 μm with a thickness of approximately 10-30 nm, close to the size of a nanoplatelet. FIG. 7 shows further accessed AFM image, in which revealed a lateral dimension of approximately 0.5 to 2.5 μm and a thickness of approximately 2.5 nm, corresponding to approximately seven layers of graphene, based on an interlayer spacing of 0.34 nm, hence confirming the formation of graphene sheets. Taking into consideration the aspects of user-friendliness, environmentally benign, time-saving, simple setup, low cost (graphite sheet can be derived from a low cost-commercial graphite resource), the method of the present invention appears to be a very efficient means of synthesizing graphene sheets.

As described above, the graphite oxide and/or graphene may be synthesized through plasma electrolytic processing at a relatively low temperature, under atmospheric pressure within a very short period of time, without the need for concentrated acids and strong oxidizing agents, and thus the present invention provides with advantages such as low cost, easy preparation, high efficiency and environmental friendless. In addition, the present invention may produce slight oxidation in plasma electrolytic process by controlling current and voltage, so that graphene with the low proportion oxide may be obtained.

The embodiments as above only illustrate the technical concepts and characteristics of the present invention; it is purposed for person ordinary skill in the art to understand and implement the present invention, but not for the limitation to claims of the present invention. That is, any equivalent change or modification in accordance with the spirit of the present invention should be covered by the appended claims.

What is claimed is:

1. A graphite oxide and graphene preparation method, comprising the following steps:

providing a plasma electrolytic apparatus, wherein the plasma electrolytic apparatus includes an electrolyte, and a cathode of the plasma electrolytic apparatus is a graphite electrode; and providing a cathodic current to the graphite electrode so as to initiate a plasma electrolytic process at a surface of the graphite electrode in contact with the electrolyte, to obtain a graphite oxide and a graphene, wherein an output voltage of the plasma electrolytic apparatus ranges from 40 V to 80 V, and an output current of the plasma electrolytic apparatus ranges from 0.5 A to 1.75 A.

2. The graphite oxide and graphene preparation method as claimed in claim 1, wherein the sum of the C═C and C—C bonds of the graphene is more than the sum of the C—O bonds.

3. The graphite oxide and graphene preparation method as claimed in claim 1, wherein the output voltage of the plasma electrolytic apparatus ranges from 40 V to 60 V.

4. The graphite oxide and graphene preparation method as claimed in claim 1, wherein one end of the graphite electrode is higher than the electrolyte.

5. The graphite oxide and graphene preparation method as claimed in claim 1, wherein the plasma electrolytic process occurs at or near the surface of the graphite electrode.

6. The graphite oxide and graphene preparation method as claimed in claim 1, wherein an area of an anode of the plasma electrolytic apparatus which is immersed in the electrolyte is 11 times larger than an area of the cathode of the plasma electrolytic apparatus which is immersed in the electrolyte.

7. The graphite oxide and graphene preparation method as claimed in claim 1, wherein the anode of the plasma electrolytic apparatus is made of conductive materials containing no aluminum, magnesium or titanium.

8. The graphite oxide and graphene preparation method as claimed in claim 1, wherein an anode of the plasma electrolytic apparatus is immersed into the electrolyte completely.

9. The graphite oxide and graphene preparation method as claimed in claim 1, wherein the electrolyte comprises hydroxyl and ammonium ions.

10. The graphite oxide and graphene preparation method as claimed in claim 1, wherein the pH of the electrolyte ranges from 11 to 14.

* * * * *